US010655075B2

(12) United States Patent
Huve et al.

(10) Patent No.: US 10,655,075 B2
(45) Date of Patent: May 19, 2020

(54) HYDROTREATING AND DEWAXING PROCESS

(71) Applicant: SHELL OIL COMPANY, Houston, TX (US)

(72) Inventors: Laurent Georges Huve, Amsterdam (NL); Meng Loong Chua, Singapore (SG)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 14/647,517

(22) PCT Filed: Nov. 26, 2013

(86) PCT No.: PCT/EP2013/074695
§ 371 (c)(1),
(2) Date: May 27, 2015

(87) PCT Pub. No.: WO2014/082985
PCT Pub. Date: Jun. 5, 2014

(65) Prior Publication Data

US 2015/0299586 A1 Oct. 22, 2015

(30) Foreign Application Priority Data

Nov. 28, 2012 (EP) ..... 12194540

(51) Int. Cl.

| | |
|---|---|
| ***C10G 65/04*** | (2006.01) |
| ***C10G 45/00*** | (2006.01) |
| ***C10G 47/00*** | (2006.01) |
| ***C10G 65/02*** | (2006.01) |
| ***C10G 49/22*** | (2006.01) |

(52) U.S. Cl.
CPC ..... *C10G 65/04* (2013.01); *C10G 45/00* (2013.01); *C10G 47/00* (2013.01); *C10G 49/22* (2013.01); *C10G 65/02* (2013.01)

(58) Field of Classification Search
CPC ..... C10G 65/04; C10G 65/043; C10G 65/08
See application file for complete search history.

(56) References Cited

U.S. PATENT DOCUMENTS

| | | | | |
|---|---|---|---|---|
| 3,140,249 | A | 7/1964 | Plank et al. | |
| 3,140,251 | A | 7/1964 | Plank et al. | |
| 3,140,253 | A | 7/1964 | Plank et al. | |
| 4,283,272 | A | 8/1981 | Garwood et al. | |
| 4,597,854 | A | 7/1986 | Penick | |
| 5,993,644 | A * | 11/1999 | Xiao | C10G 65/043 208/111.35 |
| 6,224,747 | B1 | 5/2001 | Cash et al. | |
| 6,652,735 | B2 | 11/2003 | Degnan et al. | |
| 7,077,948 | B1 * | 7/2006 | Barre | C10G 45/64 208/111.01 |

FOREIGN PATENT DOCUMENTS

| | | |
|---|---|---|
| EP | 0044965 | 2/1982 |
| EP | 1762606 | 3/2007 |
| WO | 9641849 | 12/1996 |
| WO | 0029512 | 5/2000 |
| WO | 2004033590 | 4/2004 |

OTHER PUBLICATIONS

Ken Robinson, Reactor Engineering, Encyclopedia of Chemical Processing, Taylor & Francis, p. 2557-2583. (Year: 2006).*

* cited by examiner

*Primary Examiner* — Prem C Singh
*Assistant Examiner* — Brandi M Doyle

(57) ABSTRACT

The invention provides a process for hydrotreating and dewaxing a hydrocarbon feedstock, comprising the steps of:
(a) hydrotreating the feedstock under hydrotreating conditions in a first reaction zone to obtain a first stage hydrotreated effluent; and
(b) introducing at least part of the first stage hydrotreated effluent into a second reaction zone in which the first stage hydrotreated effluent is subjected to a series of alternating dewaxing steps and hydrotreating steps.

10 Claims, No Drawings

HYDROTREATING AND DEWAXING PROCESS

PRIORITY CLAIM

The present application is the National Stage (§ 371) of International Application No. PCT/EP2013/074695, filed Nov. 26, 2013, which claims priority from European Application No. 12194540.6, filed Nov. 28, 2012 incorporated herein by reference.

FIELD OF THE INVENTION

The present invention relates to a process for hydrotreating and dewaxing a hydrocarbon feedstock.

BACKGROUND OF THE INVENTION

It is known to produce ultra low sulphur diesel fuels by first hydrodesulphurising a hydrocarbon distillate stream boiling in the gasoil boiling range and then catalytically dewaxing the desulphurised distillate stream. The catalytic dewaxing step is needed for removing waxy molecules from the distillate stream in order to reduce the cloud point and the pour point of the gasoil. The desulphurised and dewaxed gasoil may be hydrofinished for saturation of aromatic compounds. The resulting desulphurised, dewaxed and optionally hydrofinished gasoil is then used as diesel fuel or diesel fuel component.

Also in the manufacture of lubricating oils, a dewaxing step is carried out for reducing the pour point of the resulting lubricating oil.

Catalytic dewaxing steps are usually carried out in a first stage dewaxing process or a second stage dewaxing process.

In a so-called first stage dewaxing process, a gas oil is first subjected to one or more hydrotreating steps which are followed by a first stage dewaxing step which as such can be followed by a further hydrotreatment step. In such a first stage dewaxing step use is made of a base metal catalyst such as nickel-containing catalyst on a medium pore zeolite support such as, for example ZSM-5.

In a second stage dewaxing process, the gasoil is first subjected to one or more hydrotreating steps followed by a second stage dewaxing step which is carried out using a noble metal-based catalyst on a medium or large pore zeolite. Most of todays' catalytic dewaxing processes are carried out in a first stage dewaxing mode of operation. In the hydrotreating step of such a first stage dewaxing process a portion of the heteroatom species is removed from the gas oil and aromatics are saturated. The effluent so obtained is then dewaxed in the dewaxing step, aromatics and heteroatom species that are still present in the dewaxed gas oil can be removed by means of a subsequent hydrotreating step. The drawback of such a process configuration, also when all three process steps are carried out in a stacked bed configuration, is that the hydrotreating steps are exothermic, whereas quite often the dewaxing step is endothermic, resulting in a challenging temperature control over the three catalyst beds.

Object of the present invention is to provide an improved hydrotreating and dewaxing process.

SUMMARY OF THE INVENTION

This object is achieved when use is made of a particular sequence of hydrotreating and dewaxing steps, whereby in the dewaxing steps a specific catalyst is applied.

Accordingly, the present invention relates to a process for hydrotreating and dewaxing a hydrocarbon feedstock boiling in the range of from 170-450° C., comprising the steps of:

(a) hydrotreating the feedstock under hydrotreating conditions in a first reaction zone to obtain a first stage hydrotreated effluent; and (b) introducing at least part of the first stage hydrotreated effluent into a second reaction zone in which the first stage hydrotreated effluent is subjected to a series of alternating dewaxing steps and hydrotreating steps, which dewaxing steps are carried out under catalytically dewaxing conditions and the hydrotreating steps are carried out under hydrotreating conditions, wherein the first step in the series of alternating dewaxing and hydrotreating steps is a dewaxing step and the last step in the series of alternating dewaxing and hydrotreating steps is a hydrotreating step, and the dewaxing steps are carried out with a dewaxing catalyst which comprises a Group VIII metal of the Periodic Table, dealuminated aluminosilicate zeolite crystallites and a low acidity refractory oxide binder material which is essentially free of alumina.

In accordance with the present invention an improved temperature control over the reaction stages is obtained, whereas at the same time less dewaxing catalyst is required.

DETAILED DESCRIPTION OF THE INVENTION

In the second reaction zone in step (b) a number of hydrotreating steps and a number of dewaxing steps are carried out. Suitably, in step (b) three or more hydrotreating steps and three or more dewaxing steps are carried out. Preferably, in step (b) three hydrotreating steps and three dewaxing steps are carried out. In such an embodiment in the second reaction zone the first stage effluent is subsequently subjected to a first dewaxing step, a first hydrotreating step, a second dewaxing step, a second hydrotreating step, a third dewaxing step, and a third hydrotreating step.

The hydrocarbon feedstock boils in the range of from 170 to 450° C., preferably in the range of from 170-400° C.

Examples of the hydrocarbon feedstock to be used in accordance with the present invention are straight-run gasoil, hydrocracked gasoil, thermal cracked gasoil, coker gasoil, vacuum gasoil, light or heavy cycle oil, or a combination of two or more thereof. Suitably, the hydrocarbon feedstock is a solvent extracted waxy raffinate. Preferably, the hydrocarbon feedstock is a gas oil.

Such hydrocarbon feedstocks typically comprise sulphur-containing compounds, usually in a concentration in the range of from a few hundreds of ppm to a few percent of sulphur. Reference herein to gasoil or to a hydrocarbon stream boiling in the gasoil boiling range is to a hydrocarbon stream of which at least 90 wt %, preferably at least 95 wt %, is boiling in the gasoil boiling range, i.e. in the range of from 170 to 450° C.

The hydrotreating catalyst to be used in the first reaction zone in step (a) can suitably be a desulphurisation catalyst. The desulphurisation catalyst may be any hydrodesulphurisation catalyst known in the art. Suitably, the hydrotreating catalyst comprises a metal and/or a metal compound from Group VIII of the Periodic Table and a metal and/or metal compound from Group VIB of the Periodic Table. Typical hydrodesulphurization catalysts comprise a Group VIII metal of the Periodic Table and a compound of a Group VIB metal of the Periodic Table as hydrogenation components on a porous catalyst support, usually alumina or amorphous silica-alumina. Well-known examples of suitable combinations of hydrogenation compounds are cobalt-molybdenum, nickel-molybdenum, nickel-tungsten, and nickel-cobalt-molybdenum. A hydrodesulphurisation catalyst comprising compounds of nickel and/or cobalt and molybdenum as hydrogenation compounds is preferred. The hydrodesulphurisation catalyst may further comprise a cracking component such as for example Y zeolite. It is, however, preferred that no substantial hydrocracking takes place in hydrodesulphurisation step (a) of the process according to the invention. Therefore, it is preferred that the catalyst is substantially free of a cracking component. A catalyst comprising nickel and/or cobalt and molybdenum supported on alumina without a zeolitic cracking compound is particularly preferred.

The hydrotreating conditions in step (a), i.e. temperature, pressure, hydrogen supply rate, weight hourly velocity of the feedstock, are typical hydrotreating conditions. Preferably, the temperature in the hydrotreating step is in the range of from 280 to 420° C., more preferably in the range of from 300 to 400° C., and most preferably in the range of from 320 to 390° C.

Suitable hydrotreating pressures are in the range of from 10 to 200 bara. Preferably, the hydrotreating pressure is in the range of from 15 to 100 bara, more preferably in the range of from 20 to 80 bara.

It will be appreciated that the exact hydrotreating conditions in step (a) will inter alia depend on the catalyst used, the sulphur content of the hydrocarbon feedstock, the desired conversion of sulphur- and nitrogen-containing compounds and the extent to which hydrocracking of hydrocarbons boiling above 370° C. is allowed. Preferably, at most 10 vol % of the hydrocarbon feedstock boils above 370° C. is hydrocracked into lower boiling compounds. Preferably, the first stage effluent has a sulphur content of at most 150 ppmw, more preferably at most 40 ppmw, even more preferably at most 20 ppmw, still more preferably at most 10 ppmw, particular preferably at most 5 ppmw. The nitrogen content of the first stage effluent is preferably at most 50 ppmw, more preferably at most 10 ppmw, even more preferably at most 1 ppmw.

It is within the normal skills of the skilled person to choose the hydrotreating conditions in step (a) in such a way that the desired sulphur and nitrogen conversion is obtained.

In step (a), the greater part of the sulphur- and nitrogen-containing compounds that are present in the hydrocarbon feedstock are converted into hydrogen sulphide and ammonia, respectively. In step (a), hydrogen and the hydrocarbon feedstock may be supplied co-currently or counter-currently to the first reaction zone, preferably co-currently. It will be appreciated that if hydrogen and liquid hydrocarbon feedstock are co-currently supplied to the first reaction zone, a vapour-liquid mixture is obtained as the first stage effluent. Optionally, the first stage effluent can be separated into a liquid and a vapour effluent. The separation may be done by any method known in the art, for example by using a vapour/liquid separator such as a liquid draw-off tray, by stripping in a separator-stripper or by vapour/liquid separation followed by stripping of the thus-obtained liquid phase for removal of the dissolved hydrogen sulphide and ammonia. It will be appreciated that if step (a) is carried out counter-currently, a vapour effluent is withdrawn from the top of the first reaction zone and a liquid effluent from the bottom of the reaction zone. In that case the liquid effluent as withdrawn from the first reaction zone may be directly contacted with the stacked bed of dewaxing and hydrotreating catalysts in step (b). Optionally, dissolved gases are removed from the liquid effluent, typically by stripping, before the liquid effluent is contacted with the stacked bed of dewaxing and hydrotreating catalysts in step (b).

In step (b) of the process according to the invention, the first stage effluent is subjected to a sequence of dewaxing and hydrotreating steps. The first stage effluent is first subjected to a dewaxing step by contacting it with the dewaxing catalyst at dewaxing conditions, i.e. at elevated temperature and pressure and in the presence of hydrogen. Hydrogen is suitably supplied to the stacked bed of catalysts in the second reaction zone co-currently or counter-currently, preferably co-currently, with respect to the first stage effluent.

In step (b) a number of catalytic dewaxing steps is applied. Suitably, in step (b) three or more dewaxing steps are applied. Preferably, in step (b) three dewaxing steps are applied.

By catalytic dewaxing is here meant a process for decreasing the pour point or cloud point by selectively converting the components of the oil feed which impart a high pour point or cloud point to products which do not impart a high pour point or cloud point. Products which impart a high pour point or cloud point are compounds having a high melting point. These compounds are referred to as waxes. Wax compounds include for example high temperature melting normal paraffins, iso-paraffins and mono-ringed compounds. The pour point or cloud point is preferably reduced by at least 10° C. and more preferably by at least 20° C. It has been found possible to reduce the cloud and pour point by more than 30° C., which is very advantageous when preparing some winter grade gas oil (diesel) fuels.

The dewaxing steps in step (b) are carried out under catalytic dewaxing conditions with a catalyst composition comprising a Group VIII metal hydrogenation component, dealuminated aluminosilicate zeolite crystallites and a low acidity refractory oxide binder material which is essentially free of alumina. In the context of the present application the term "essentially free of alumina" means that the low acidity refractory oxide binder material comprises less than 95 w %, preferably less than 99 wt % alumina, based on the total weight of the low acidity refractory oxide binder material. More preferably, the low acidity refractory oxide binder material is completely free of alumina.

It has been found that this type of dewaxing catalyst is very stable over time even though a high content of sulphur is present in the oil feed. Examples of such catalysts are described in WO-A-9641849. Moreover, it has been found that much less coke is formed when use is made of this type of catalyst when compared with catalysts containing an alumina-based binder material The aluminosilicate zeolite crystallites preferably have pores with a diameter in the range of from 0.35 to 0.80 nm. More preferably, the aluminosilicate zeolite crystallites have pores comprising 10 oxygen atoms. This diameter refers to the maximum pore diameter. As is generally recognised, the pores in a molecular sieve are polygonal shaped channels having a minimum and a maximum pore diameter. For the purpose of the present invention the maximum pore diameter is the critical parameter, because it determines the size of the waxy molecules which can enter the pores. More preferably, the zeolite crystallites have a Constraint Index of between 2 and 12. The Constraint Index is a measure of the extent to which a zeolite provides control to molecules of varying sizes to its internal structure is of the zeolite. Zeolites which provide a highly restricted access to and egress from its internal structure have a high value for the Constraint Index. On the other hand, zeolites which provide relatively free access to the internal zeolite structure have a low value for the Constraint Index, and usually pores of large size. The method by which Constraint Index is determined is described fully in U.S. Pat. No. 4,016,218, incorporated herein by reference for details of the method. Examples of aluminosilicate zeolites having a Constraint Index of between 2 and 12 and which are suitable for to be used in the present invention are ferrierite, ZSM-5, ZSM-11, ZSM-12, ZSM-22, ZSM-23, ZSM-35, ZSM-38, ZSM-48, ZSM-57, SSZ-23, SSZ-24, SSZ-25, SSZ-26, SSZ-32, SSZ-33 and MCM-22 and mixtures of two or more of these. Preferred aluminosilicate zeolites are of the MFI-topology for example ZSM-5.

The crystallite size of the zeolite may be as high as 100 micron. The crystallite size of the individual particles can be determined using high resolution scanning electron microscopy. The size of the crystallite is the longest or dominant side of the particle.

Preferably small crystallites are used in order to achieve an optimum catalytic activity. Preferably crystallites smaller than 10 micron and more preferably smaller than 1 micron are used. The practical lower limit is suitably 0.1 micron.

The dewaxing catalyst used in the dewaxing steps in step (b) also comprises a low acidity refractory oxide binder material which is essentially free of alumina. Examples are low acidity refractory oxides such as silica, zirconia, titanium dioxide, germanium dioxide, boria and mixtures of two or more of these. The most preferred binder is silica. The weight ratio of modified molecular sieve to binder is suitably within the range of from 05/95 to 95/05.

The dealumination of the aluminosilicate zeolite results in a reduction of the number of alumina moieties present in the zeolite and hence in a reduction of the mole percentage of alumina. The expression "alumina moiety" as used in this connection refers to an $Al_2O_3$-unit which is part of the framework of the aluminosilicate zeolite, i.e. which has been incorporated via covalent bindings with other oxide moieties, such as silica ($SiO_2$), in the framework of the aluminosilicate zeolite. The mole percentage of alumina present in the aluminosilicate zeolite is defined as the percentage of moles $Al_2O_3$ relative to the total number of moles of oxides constituting the aluminosilicate zeolite (prior to dealumination) or modified molecular sieve (after dealumination).

Preferably, the surface of the zeolite crystallites are selectively dealuminated. A selective surface dealumination results in a reduction of the number of surface acid sites of the zeolite crystallites, whilst not affecting the internal structure of the zeolite crystallites.

Dealumination can be attained by methods known in the art. Particularly useful methods are those, wherein the dealumination selectively occurs, or anyhow is claimed to occur selectively, at the surface of the crystallites of the molecular sieve. Examples of dealumination processes are described in the afore mentioned WO-A-9641849.

Preferably, dealumination is performed by a process in which the zeolite is contacted with an aqueous solution of a fluorosilicate salt wherein the fluorosilicate salt is represented by the formula:

$$(A)_{2/b}SiF_6$$

wherein 'A' is a metallic or non-metallic cation other than H+ having the valence 'b'. This treatment will be also referred to as the AHS treatment. Examples of cations 'b' are alkylammonium, $NH4^+$, $Mg^{++}$, $Li^+$, $Na^+$, $K^+$, $Ba^{++}$, $Cd^{++}$, $Cu^+$, $Ca^{++}$, $Cs^+$, $Fe^{++}$, $Co^{++}$, $Pb^{++}$, $Mn^{++}$, $Rb^+$, $Ag^+$, $Sr^{++}$, $Tl^+$, and $Zn^{++}$. Preferably 'A' is the ammonium cation. The zeolite material may be contacted with the fluorosilicate salt at a pH of suitably between 3 and 7. Such a dealumination process is for example described in U.S. Pat. No. 5,157,191. The dealumination treatment is referred to as the AHS-treatment.

The dewaxing catalyst to be used in accordance with the present invention is preferably prepared by first extruding the aluminosilicate zeolite with the binder and subsequently subjecting the extrudate to a dealumination treatment, preferably the AHS treatment as described above. It has been found that an increased mechanical strength of the catalyst extrudate is obtained when prepared according to this sequence of steps.

The Group VIII metal of the Periodic Table is suitably added to the catalyst extrudate comprising the dealuminated aluminosilicate zeolite crystallites by known techniques, such as ion-exchange techniques. Typical ion-exchange techniques call for contacting the selected zeolite with a salt of the desired replacing cation. Although a wide variety of salts can be employed, particular preference is given to chloride, nitrates and sulphates. Representative ion-exchange techniques are disclosed in a wide variety of patents including U.S. Pat. Nos. 3,140,249, 3,140,251 and 3,140,253.

In the dewaxing step use is made of dewaxing catalyst which comprises a Group VIII metal hydrogenation component. Group VIII metal components include those components based on both noble and non-noble metals. Suitable Group VIII metal components, accordingly, are palladium, platinum, nickel and/or cobalt in sulphidic, oxidic and/or elemental form. Preferably, the dewaxing catalyst comprises nickel in sulphidic, oxidic and/or elemental form. The total amount Group VIII metal of the Periodic Table will suitably not exceed 10% by weight calculated as element and based on total weight of support, and preferably is in the range of from 0.1 to 5.0% by weight, more preferably from 0.2 to 3.0% by weight. The Group VIII metal hydrogenation component is preferably nickel.

The catalytic dewaxing conditions in step (b) of the process according to the invention are typical catalytic dewaxing conditions. Therefore, the temperature is suitably in the range of from 250 to 420° C., preferably in the range of from 280 to 420° C., and more preferably in the range of from 300 to 400° C. Suitable dewaxing pressures are in the range of from 10 to 200 bara. Preferably, the dewaxing pressure is in the range of from 15 to 100 bara, more preferably in the range of from 20 to 80 bara. The dewaxing steps are carried out in the presence of hydrogen. Hydrogen is suitably supplied to the second reaction zone at a rate of 250 to 750 Nl/kg gasoil.

In step (b) a number of hydrotreating steps are applied. Suitably in step (b) two or more hydrotreating steps are applied. Preferably, in step (b) three hydrotreating steps are applied. Preferably, the temperature in the hydrotreating step is in the range of from 280 to 420° C., more preferably in the range of from 300 to 400° C., and most preferably in the range of from 320 to 390° C. Suitable hydrotreating pressures are in the range of from 10 to 200 bara. Preferably, the hydrotreating pressure is in the range of from 15 to 100 bara, more preferably in the range of from 20 to 80 bara.

In the hydrotreating steps in step (b) heteroatom species that are still present in the first stage effluent are at least partly removed. In addition, at least part of the aromatics still present in the dewaxed first stage effluent is saturated. In a preferred embodiment of the present invention, in the hydrotreating steps in step (b) use is made of a base metal catalyst such as nickel-molybdenum on an alumina support.

The stacked bed of catalysts as applied in the second reaction zone in step (b) preferably comprises a first bed which comprises the dewaxing catalyst, a second bed which comprises hydrotreating catalyst, a third bed which comprises the dewaxing catalyst, a fourth bed which comprises a hydrotreating catalyst, a fifth bed which comprises a dewaxing catalyst, and a sixth bed which comprises a hydrotreating catalyst. Suitably, in the second, fourth and sixth bed use is made of a similar hydrotreating catalyst.

The particular sequence of the catalyst beds as applied in step (b) establish an improved temperature control over the reaction stages because large temperature changes between the beds that comprise the dewaxing catalyst and the catalyst beds that comprise the hydrotreating catalyst can be avoided.

In addition to the improved temperature control, a major advantage is the surprising fact that less total dewaxing catalyst is required in the separate catalyst beds than the total amount of dewaxing catalyst that is normally required in a single bed to obtain a similar performance in a first stage dewaxing step. In accordance with the present invention a reduction of up to 20-25% of total volume of dewaxing catalyst can be established.

Preferably, the temperature in the different catalyst beds in the second reaction zone is the same. It is, however, also highly attractive to operate the hydrotreating steps and the dewaxing steps at temperatures that only differ a little. For example, the dewaxing steps can be carried out at a temperature that is 5 to 30° C. lower than the temperature at which the hydrotreating steps are carried out in step (b). In between catalysts beds interbed quenches may be used to cool the first stage effluent. This might be advantageous in case only limited dewaxing is needed.

The stacked bed of catalysts may consist of a single bed of the dewaxing and hydrotreating catalysts on top of each other, i.e. without space between the six beds. Alternatively, the six beds may be spaced apart. Each of the six beds may be divided in separate beds in series. In the case of two or more spaced-apart beds, interbed cooling is possible to remove heat released during the exothermic hydrotreating steps, for example by means of an interbed quench.

The first reaction zone and the second reaction zone may be arranged in the same reactor or in separate reactor vessels. Preferably, the first reaction zone and the second reaction zone are both located in the same reactor vessel, whereby the first reaction zone is arranged upstream with respect to the second reaction zone.

Preferably, the volume of each of the catalyst beds in which the respective hydrotreating steps are carried out is smaller than the volume of each of the catalyst beds in which the respective dewaxing steps are carried out. More preferably, the total volume of the beds of hydrotreating catalyst is in the range of from 10 to 65% of the total volume of the beds of dewaxing catalyst. Reference herein to the volume of the beds of hydrotreating catalyst is to the total volume of those beds without the interbed space. The same applies mutates mutandis for the volume of the beds of dewaxing catalyst.

In the process according to the invention, preferably the entire first stage effluent of the first reaction zone is introduced into the second reaction zone.

The cloud point of the second stage effluent as obtained in step (b) is in the range of from 10 to 20° C. lower than the cloud point of the first stage effluent as obtained in step (a).

The second stage effluent as obtained in step (b) can suitably be sent to a diesel fuel blending pool directly, i.e. without further treatment. Reference herein to treatment is to a treatment wherein the molecular structure of gasoil components is changed and thus excludes blending.

The second stage effluent may be separated into a gaseous fraction and a liquid fraction. Such separation or fractionation can be attained by conventional methods, such as by distillation under atmospheric or reduced pressure. Of these, distillation under reduced pressure, including vacuum flashing and vacuum distillation, is most suitably applied. The cutpoint(s) of the distillate fraction(s) is/are selected such that each product distillate recovered has the desired properties for its envisaged application.

In the process according to the invention, a hydrotreated and dewaxed gasoil is obtained which is very suitable to be used as diesel fuel in cold environments, e.g. in winter time. In summer time, it will not always be necessary to reduce the pour point and cloud point of hydrotreated gasoil, but it might be desirable to hydrogenate the gasoil for aromatics saturation or cetane or density improvement. It is an advantage of the process according to the present invention that the equipment (hardware including catalysts) needed for the process can also be used to operate in a so-called summer mode. This so-called summer mode operation is similar to the process according to the invention, with the exception that the catalyst beds in the second reaction zone in step (b) are kept at low temperature, i.e. a temperature at which no dewaxing takes place. This may for example be achieved by quenching the first stage effluent as obtained in step (a). In this way, the hydrocarbon feedstock is only hydrotreated and will not be dewaxed. Thus, a gasoil suitable to be sent to a diesel fuel blending pool for summer-grade diesel fuel is obtained. It is noted that the summer-mode operation described above is not a process according to the invention.

The invention will be illustrated by the following non-limiting examples.

EXAMPLE 1

According to the Invention

A hydrocarbon feedstock having the properties as listed in Table 1 was contacted in a first reaction zone in the presence of hydrogen with a hydrotreating catalyst at a temperature of 349° C., an outlet pressure of 70 bara, a weight hourly space velocity (WHSV) of 0.71 kg/l·hr and a once through gas rate of 341 Nl/kg. The hydrotreating catalyst is DN3531 (ex-Criterion) which comprises nickel-molybdenum on an alumina support.

TABLE 1

| Property | Method | Units | |
|---|---|---|---|
| Feed Rate | | BBL/D | 70,000 |
| Specific gravity | ASTM D1298 | | 0.879 |
| Sulphur content | ASTM D2622 | % wt | 1.50 |
| Nitrogen content | ASTM D4629 | ppmwt | 230 |
| Bromine number | ASTM D1159 | g/100 g | 0.8 |
| Aromatics content: | IP 391-95 | | |
| Mono aromatics | | % wt | 16.4 |
| Di aromatics | | % wt | 15.3 |
| Tri aromatics | | % wt | 3.1 |
| Total aromatics | | % wt | 34.8 |
| Cetane index (CI) | ASTM D976 | — | 45.2 |
| ASTM Distillation: | ASTM D86 | | |

TABLE 1-continued

| Property | Method | Units | |
|---|---|---|---|
| IBP | | ° C. | 208 |
| 5% | | ° C. | 248 |
| 10% | | ° C. | 263 |
| 30% | | ° C. | 287 |
| 50% | | ° C. | 305 |
| 70% | | ° C. | 326 |
| 90% | | ° C. | 361 |
| 95% | | ° C. | 377 |
| EP | | ° C. | 383 |

Pour point measured by NF T 60-105, Initial boiling point (IBP), T50 and final boiling point (FBP) measured by ASTM D 2892m, kinematic viscosities by NF-EN-ISO 3104, sulphur by ASTM D 5453, nitrogen content by SMS 2695m.

The first stage effluent so obtained is introduced into a second reaction which comprises six catalyst beds in a stacked bed configuration. The first, third and fifth beds contained a dewaxing catalyst, whereas the second and fourth and sixth beds contained a hydrotreating catalyst. The volumes of the catalysts used are shown in Table 2. The hydrotreating catalyst used in the second, fourth and sixth beds comprises DN-3531 (ex-Criterion) comprising nickel-molybdenum on an alumina support. The dewaxing catalyst used in the first, third and fifth bed comprises SDD 800 (ex-Criterion), which is a nickel-based catalyst.

The reaction conditions applied in the six beds are indicated in Table 2. The properties of the product obtained from the hydrotreating zone are shown in Table 3.

TABLE 2

| | Catalyst type | | Vol. | Inlet/outlet temp. |
|---|---|---|---|---|
| Bed 1 | SDD 800 | Dewaxing catalyst | 45 m3 | 369/364 |
| Bed 2 | DN3531 | Hydrotreating catalyst | 25 m3 | 364/372 |
| Bed 3 | SDD 800 | Dewaxing catalyst | 45 m3 | 372/369 |
| Bed 4 | DN3531 | Hydrotreating catalyst | 25 m3 | 369/375 |
| Bed 5 | SDD 800 | Dewaxing catalyst | 45 m3 | 375/369 |
| Bed 6 | DN 3531 | Hydrotreating catalyst | 70 m3 | 369/377 |

TABLE 3

| Product Properties | | |
|---|---|---|
| Product type | | Gasoil |
| Specific gravity | | 0.855 |
| Sulphur | ppm w | 8.52 |
| Nitrogen | ppm w | 0.05 |
| Aromatics | | |
| Method | | IP-391 |
| Mono | w % | 23.01 |
| Di | w % | 2.75 |
| Tri+ | w % | 0.58 |
| Total | w % | 26.34 |
| Distillation | | |
| Method | | ASTM D-86 |
| IBP | ° C. | 202 |
| 5% | ° C. | 236 |
| 10% | ° C. | 246 |
| 30% | ° C. | 274 |
| 50% | ° C. | 293 |
| 70% | ° C. | 314 |
| 90% | ° C. | 345 |
| 95% | ° C. | 363 |
| FBP | ° C. | 384 |
| Cloud point | ° C. | −12 |
| Cetane number | | 50.6 |
| Cetane Index ASTM D-976 | | 51.9 |
| Cetane Index ASTM D-4737 | | 52.6 |

EXAMPLE 2

Comparative Example

A hydrotreating and dewaxing process was carried out as follows. The hydrocarbon feedstock as described in Example 1 was contacted in a first reaction zone in the presence of hydrogen with a hydrotreating catalyst at a temperature of 349° C., an outlet pressure of 70 bara, a weight hourly space velocity (WHSV) of 0.71 kg/l·hr and a once through gas rate of 341 Nl/kg. The hydrotreating catalyst was the same catalyst as used in the first reaction zone in Example 1.

The first stage effluent so obtained is introduced into a second reaction which comprises two catalyst beds in a stacked bed configuration. The first bed contained a dewaxing catalyst, whereas the second bed contained a hydrotreating catalyst. The hydrotreating catalyst and the dewaxing catalyst used were the same as applied in the second reaction zone in Example 1. The volumes of the catalysts used are shown in Table 4. The reaction conditions applied in the five beds are indicated in Table 4. The properties of the product obtained from the second reaction zone are shown in Table 5

TABLE 4

| | Catalyst type | | Vol. (m3) | Inlet/outlet temp. |
|---|---|---|---|---|
| Bed 1 | SDD 800 | Dewaxing catalyst | 190 | 369/354 |
| Bed 2 | DN3531 | Hydrotreating catalyst | 70 | 354/377 |

TABLE 5

| Product Properties | | |
|---|---|---|
| Product type | | Gasoil |
| Specific gravity | | 0.855 |
| Sulphur | ppm w | 8.52 |
| Nitrogen | ppm w | 0.05 |
| Aromatics | | |
| Method | | IP-391 |
| Mono | w% | 23.01 |
| Di | w% | 2.75 |
| Tri+ | w% | 0.58 |
| Total | w% | 26.34 |
| Distillation | | |
| Method | | ASTM D-86 |
| IBP | ° C. | 202 |
| 5% | ° C. | 236 |
| 10% | ° C. | 246 |
| 30% | ° C. | 274 |
| 50% | ° C. | 293 |
| 70% | ° C. | 314 |
| 90% | ° C. | 345 |
| 95% | ° C. | 363 |
| FBP | ° C. | 384 |
| Cloud point | ° C. | −12 |
| Cetane number | | 50.6 |

TABLE 5-continued

| | |
|---|---|
| Cetane Index ASTM D-976 | 51.9 |
| Cetane Index ASTM D-4737 | 52.6 |

From the above results it will be clear that in accordance with the present invention the temperature is more attractive controlled over the various stages in the first and second reaction zones, whereas at the same time less dewaxing catalyst needed to be used to obtain a product of comparable properties.

That which is claimed is:

1. A process for hydrotreating and dewaxing a hydrocarbon feedstock that is a gas oil comprising sulfur-containing compounds and boiling in the range of from 170-450° C., wherein the process comprises the steps of:

(a) hydrotreating the feedstock under hydrotreating conditions within a first reaction zone containing a first hydrotreating catalyst comprising a Group VII metal to metal compound and a Group VIB metal to metal compound on a porous catalyst support to obtain a first stage hydrotreated effluent having a sulfur content of at most 150 ppmw and a first stage effluent cloud point;

(b) introducing at least part of the first stage hydrotreated effluent into a second reaction zone in which the first stage hydrotreated effluent is subjected to a series of alternating dewaxing steps and hydrotreating steps, which three or more dewaxing steps are carried out under catalytically dewaxing conditions and three or more hydrotreating steps are carried out under hydrotreating conditions, wherein the first step in the series of alternating dewaxing and hydrotreating steps is a dewaxing step and the last step in the series of alternating dewaxing and hydrotreating steps is a hydrotreating step, and each dewaxing step is carried out with a volume of 45 cubic meter ($m^3$) of a dewaxing catalyst which comprises a Group VIII metal hydrogenation component, dealuminated aluminosilicate zeolite crystallites, having crystallite sizes in the range of from 0.1 micron to 100 microns, and a low acidity refractory oxide binder material which is essentially free of alumina, and the hydrotreating steps are carried out with a second hydrotreating catalyst, wherein total volume of beds of the second hydrotreating catalyst is in the range of from 10% to 65% of the total volume of the beds of dewaxing catalyst; and (c) obtaining from step (b) a second stage effluent having a second stage effluent cloud point that is lower than the first stage effluent cloud point.

2. The process according to claim 1, wherein in the second reaction zone three hydrotreatment steps and three dewaxing steps are carried out.

3. The process according to claim 2, wherein the hydrotreating in step (a) is carried out at a temperature in the range of from 300-400° C. and at a pressure in the range of from 20-80 bara.

4. The process according to claim 3, wherein the hydrotreating steps in step (b) are carried out in the presence of hydrogen at a temperature in the range of from 280-420° C. and at a pressure in the range of from 20-80 bara.

5. The process according to claim 4, wherein the dewaxing steps in step (b) are carried out in the presence of hydrogen at a temperature in the range of from 280-420° C. and at a pressure in the range of from 20-80 bara.

6. The process according to claim 5, wherein the Group VIII metal hydrogenation component of the dewaxing catalyst is nickel.

7. The process according to claim 6, wherein the low acidity binder is silica.

8. The process according to claim 7, wherein the aluminosilicate zeolite crystallites have pores comprising 10 oxygen atoms.

9. The process according to claim 8, wherein the aluminosilicate zeolite crystallites are of the MFI type.

10. The process according to claim 9, wherein the dealuminated aluminosilicate zeolite crystallites are obtained by contacting the zeolite crystallites with an aqueous solution of a fluorosilicate salt wherein the fluorosilicate salt is selected from the group consisting of ammonium fluorosilicate, sodium fluorosilicate, magnesium fluorosilicate, potassium fluorosilicate, and zinc fluorosilicate.

* * * * *